United States Patent [19]

Repetto et al.

[11] 3,959,575

[45] May 25, 1976

[54] HOLLOW ANNULAR ELECTRODE FOR FEEDING POWDERED METAL TO ELECTROSLAG REMELTING PROCESSES

[75] Inventors: Eugenio Repetto, Genoa; Aldo Ramacciotti, Rome, both of Italy

[73] Assignee: Centro Sperimentale Metallurgico S.p.A., Rome, Italy

[22] Filed: Oct. 11, 1974

[21] Appl. No.: 514,260

[30] Foreign Application Priority Data

Nov. 12, 1973 Italy ..... 53616/73

[52] U.S. Cl. ..... 13/18

[51] Int. Cl.[2] ..... H05B 7/107

[58] Field of Search ..... 13/9 ES, 13, 18

[56] References Cited

UNITED STATES PATENTS

| | | | |
|---|---|---|---|
| 1,640,735 | 8/1927 | Soderberg | 13/18 |
| 2,297,560 | 9/1942 | Hopkins | 13/13 |
| 3,610,319 | 10/1971 | Kleinhagauer et al. | 13/9 ES |
| 3,850,226 | 11/1974 | Cadden et al. | 13/18 X |

*Primary Examiner*—R. N. Envall, Jr.

*Attorney, Agent, or Firm*—Young & Thompson

[57] ABSTRACT

A self sintering compound tubular electrode suitable particularly for making metal articles by supply of metal with an electroslag process, consisting of a plurality of concentric walls, each pair of said concentric walls defining an annular cavity containing in the melting zone of the electrode a layer of sintered metal powder, and above said sintered layer, a second layer of powder not yet sintered.

4 Claims, 1 Drawing Figure

Figure 1:
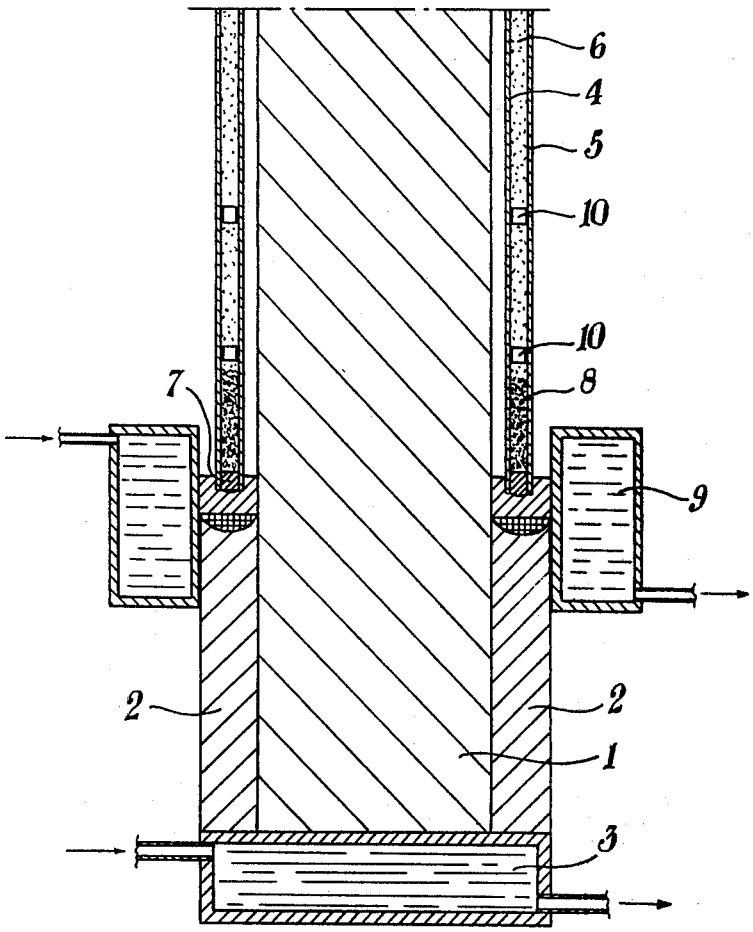

HOLLOW ANNULAR ELECTRODE FOR FEEDING POWDERED METAL TO ELECTROSLAG REMELTING PROCESSES

The present invention relates to an improved device for manufacturing metal bodies electroslag remelting. More particularly, this invention relates to a device allowing at least one dimension of a metal body to be increased by electroslag remelting, of one or more layers, of a metal or alloy, on the original metal body, the chemical composition of which can be either equal to or different from that of the supplied metal or alloy.

It is known that modern technology requires more and more frequently metal bodies having large dimensions and particularly free from defects or impurities and usually having a homogeneous chemical composition. Said metal bodies can also be required with a composition which is variable either transversely or longitudinally, each of the different composition zones being however particularly homogeneous.

This problem has two aspects:

Obtaining ingots having large and very large dimensions (for instance, for manufacturing rotors for turbines, or plates having remarkable dimensions for nuclear reactors) the manufacture of which according to conventional techniques can be difficult even if not entirely unfeasible due to the difficulties met in the known techniques in casting large bodies as far as the homogeneity, the absence of defects and of inclusions and the compliance with requisits of high performances and characteristics as required in the manufactured articles of the related kind, are concerned.

Obtaining manufactured products having a rotation symmetry (for instance rolling mill cylinders) wherein a central core will be coated with a more or less thick layer of another metal or alloy having characteristics different from those of the central core.

Various solutions have been proposed for obviating the drawbacks according to the preceding techniques, and among these solutions the most interesting include re-melting, under electroconductive slag, the metal to be supplied.

For instance for manufacturing ingots for forging purposes it has been proposed to start from one or more ingots having small dimensions and obtained by conventional casting processes, said ingots being subsequently used as electrodes in a subsequent melting process under electroslag. This process, however, is very slow, and has the main drawback of reproducing even if in a slightly attenuated form, in the ingot, or in another metal body as obtained the same layers of composition (segregations) as present in the ingots used as electrodes.

Another known process consists in coating a core which is caused to revolute slowly about its longitudinal axis, horizontally located, with an outer layer obtained by re-melting under electroconductive slag a set of electrodes within an annular space the inner wall of which consists of the same body which is to be coated, while the outer wall consists of a copper body suitably cooled and concentrically arranged with respect to said core. This second process besides being slow offers remarkable drawbacks and difficulties of embodiment, to say nothing of the fact that several electrodes must be used simultaneously, and the core must be caused to revolve, with all associated mechanical complications and with the lack of uniformity of the composition of the supplied layer due to the use of more electrodes.

In order to remove the main drawback of the re-melting processes under electroconductive slag, namely the transfer to the obtained product of the same lack of homogeneity of the composition as found in the raw electrode, it has been proposed to use metal powder as a supply material, whereby it is extremely simple to obtain, by mixing, a raw composition particularly exact and controllable. However, with the powders, the problem arises of causing said powders to reach the melting zone in suitable amount. Various solutions have been proposed for solving this problem, among which is a process as disclosed in the U.S. patent application of the same Applicants, Ser. No. 419,380 filed Nov. 27, 1973 and concerning the manufacture of ingots by re-melting of powders under electroconductive slag. The present invention allows said method and all advantages attached thereto, to be applied to the particular purpose of obtaining metal bodies in which a central core is coated with one or more layers of a metal or alloy having a composition either equal to or different from that of the original core, provided that, of course, it will be compatible with the core itself.

The device according to the present invention consists essentially of a tubular electrode suitable to be placed concentrically about the body to be coated, and having transverse inner dimensions such as to leave between the outer surface of said body to be coated and the inner wall of the electrode itself a clearance having a thickness comprised between 2% and 15% of the maximum transverse dimension of the body to be coated. Said tubular electrode in a first embodiment thereof consists of two metal tubular concentric walls spaced apart from each other by an annular clearance or cavity having a thickness comprised between 2 and 10 cms., and kept mutually at the pre-fixed distance by means of spacers. Into said clearance or annular cavity a metal powder will be introduced and said powder will sinter in correspondence with the part of the electrode which is immersed in the slag.

In another embodiment, the tubular electrode according to the present invention consists of a multiplicity of concentric metal tubes, so as to present a plurality of concentric walls, each pair of said contiguous walls defining an annular cavity having a thickness comprised approximately between 2 and 10 cms., said walls being positioned by suitable spacers so as to maintain at its prefixed value throughout the length of the electrode the thickness of said annular cavity. The area transversely occupied of the cross-section of said electrode, by said spacers is preferably not greater than the 20% of the area of the annual cavity to which said spacers relate.

Into each of said annular cavities a metal powder will be introduced, said powder having the desired composition; said powder is caused to accumulate within said annular cavities and then it is caused to sinter progressively due to the part of the heat developed during the melting under slag of the electrode itself, as disclosed in the previously cited patent application.

Said electrode can be continuously formed and extended by sequential connection of more tubes forming the concentric walls of said electrode. Said concentric walls are not necessarily rigid with one another, and are kept in their position at their top, each by a grasping device of a known type which can also serve the function of supplying the current, and at their bottom by the layer of sintered powder in the annular cavities defined by said concentric walls.

The electrode according to the present invention is accordingly a compound tubular electrode the structure of which is variable both longitudinally and transversely, characterized by a plurality of concentric walls defining by pairs at least one annular cavity; each of said annular cavities being filled in the melting zone of the electrode by a layer of metal powder sintered through a height not less than the clearance between the electrode and the body to be coated, and above said sintered powder layer, by a second layer of non sintered metal powder having a height greater than twice said clearance. Said concentric walls are kept at a mutual pre-fixed distance by means of spacers inserted between the walls themselves.

The device according to the present invention will be now described only by way of non limitative example, in connection with an embodiment thereof comprising a single pair of concentric tubes containing the material to be supplied.

This embodiment is shown in the drawing, which is a vertical sectional view of the device according to the present invention, in combination with the body to be coated and the accessory devices allowing the present invention to be utilized.

A metal body 1, which is to be coated with a metal layer 2, is located on a base 3, water cooled and electrically conductive. About said body 1 is located concentrically the electrode according to the present invention, formed in this particular embodiment by a first tubular wall 4, by a second tubular wall 5, defining an annular cavity 6 within which, by means of devices known in the art and not shown in the FIGURE, the metal powder having the selected composition is caused to fall. Said metal powder forms, in the melting zone of the electrode and due to the heat developed in said melting zone, a sintered layer 7 on which rests a second layer of not yet sintered metal powder 8.

The heat necessary for melting the electrode and for forming the sintered layer is supplied as is known, due to the Joule effect by the electric current flowing between the electrode itself, the base plate 3 and the ingot mould. Inside the melting zone is arranged, in order to contain the liquid metal and to impart a shape to the product, a water cooled annular copper ingot mould 9. The numeral reference 10 denotes the spacers which serve to maintain equispaced the tubular walls 4 and 5.

Having thus described the present invention, what is claimed is:

1. A hollow annular electrode for feeding powdered metal to electroslag remelting processes, comprising a plurality of concentric cylindrical metal walls that are spaced apart from each other, spacer means holding said walls in predetermined spaced apart relationship, and a quantity of metal powder between said walls.

2. An electrode as claimed in claim 1, said metal powder at one end of said electrode being sintered and said metal powder remote from said one end being unsintered.

3. An electrode as claimed in claim 2, and a central metal core disposed within said hollow electrode with clearance, said sintered metal powder having a height lengthwise of said core which is at least as great as said clearance, said unsintered metal powder having a height lengthwise of said core which is at least twice the value of said clearance.

4. An electrode as claimed in claim 1, said spacer means occupying at most 20% of the cross-sectional area of the space between said walls.

* * * * *